US010826164B2

(12) United States Patent
Peitzer et al.

(10) Patent No.: US 10,826,164 B2
(45) Date of Patent: Nov. 3, 2020

(54) ANTENNA SYSTEM FOR UNMANNED AERIAL VEHICLE

(71) Applicant: AT&T Mobility II LLC, Atlanta, GA (US)

(72) Inventors: Haywood S. Peitzer, Randolph, NJ (US); Carl Lindsey Martin, II, Round Rock, TX (US); Scott Prather, Seattle, WA (US)

(73) Assignee: AT&T MOBILITY II LLC, Atlanta, GA (US)

( * ) Notice: Subject to any disclaimer, the term of this patent is extended or adjusted under 35 U.S.C. 154(b) by 0 days.

(21) Appl. No.: 16/548,592

(22) Filed: Aug. 22, 2019

(65) Prior Publication Data

US 2019/0379106 A1 Dec. 12, 2019

Related U.S. Application Data

(62) Division of application No. 15/466,318, filed on Mar. 22, 2017, now Pat. No. 10,418,694.

(51) Int. Cl.

| | |
|---|---|
| ***H01Q 1/28*** | (2006.01) |
| ***H01Q 1/18*** | (2006.01) |
| ***H01Q 3/08*** | (2006.01) |
| ***H01Q 1/22*** | (2006.01) |
| ***H01Q 21/28*** | (2006.01) |

(52) U.S. Cl.

CPC ..... *H01Q 1/28* (2013.01); *H01Q 1/18* (2013.01); *H01Q 1/2291* (2013.01); *H01Q 3/08* (2013.01); *H01Q 21/28* (2013.01)

(58) Field of Classification Search

None

See application file for complete search history.

(56) References Cited

U.S. PATENT DOCUMENTS

| | | | | |
|---|---|---|---|---|
| 5,410,325 | A * | 4/1995 | Friedrich | H01Q 1/005 343/711 |
| 7,683,853 | B2 | 3/2010 | Michaelis | |
| 8,907,846 | B2 | 12/2014 | Sharawi et al. | |
| 9,407,000 | B1 | 8/2016 | Willstein | |
| 9,705,185 | B2 * | 7/2017 | Hall | H01Q 1/28 |

(Continued)

OTHER PUBLICATIONS

Ali Mohammad Hayajneh, Syed Ali Raza Zaidi, Des. C. Mclernon, Mounir Ghogho, "Optimal Dimensioning and Performance Analysis of Drone-Based Wireless Communications", IEEE, 2016.

*Primary Examiner* — Trinh V Dinh

(74) *Attorney, Agent, or Firm* — Haynes and Boone, LLP

(57) ABSTRACT

An antenna system for an unmanned aerial vehicle (UAV) includes an antenna and a self-leveling antenna mount configured to mount the antenna to the UAV. The antenna is configured to receive commands for the UAV via a network and to transmit data from the UAV via the network. The antenna has a transmit-receive pattern with a peak strength in a first direction aligned with an axis of the antenna. The transmit-receive pattern falls off in directions away from the axis of the antenna. The self-leveling antenna mount is configured to adjust an orientation of the antenna to maintain substantial alignment between the first direction and a straight downward direction relative to the UAV despite a change in roll, pitch, or bank of the UAV. In some embodiments, the axis of the antenna is a downward vertical axis of the antenna.

16 Claims, 4 Drawing Sheets

(56) References Cited

U.S. PATENT DOCUMENTS

| | | | | |
|---|---|---|---|---|
| 2003/0214448 | A1* | 11/2003 | Downs | H01Q 1/185 343/757 |
| 2014/0218239 | A1* | 8/2014 | Sharawi | G01S 3/38 342/422 |
| 2015/0237569 | A1 | 8/2015 | Jalali | |
| 2016/0013858 | A1 | 1/2016 | Jalali | |
| 2016/0088498 | A1 | 3/2016 | Sharawi | |
| 2016/0112116 | A1 | 4/2016 | Jalali | |
| 2016/0134358 | A1 | 5/2016 | Jalali | |
| 2016/0337027 | A1 | 11/2016 | Jalali | |
| 2016/0380692 | A1 | 12/2016 | Jalali | |
| 2018/0233813 | A1 | 6/2018 | Yui et al. | |
| 2018/0229833 | A1 | 8/2018 | Kimchi et al. | |
| 2018/0229837 | A1 | 8/2018 | Kimchi et al. | |
| 2018/0248613 | A1 | 8/2018 | Peitzer et al. | |

* cited by examiner

ANTENNA SYSTEM FOR UNMANNED AERIAL VEHICLE

RELATED APPLICATIONS

The present application is a divisional of U.S. patent application Ser. No. 15/466,318, filed on Mar. 22, 2017, which is incorporated by reference herein in its entirety.

TECHNICAL FIELD

The present disclosure relates generally to communication systems for unmanned aerial vehicles and more specifically to an antenna and antenna system for unmanned aerial vehicles.

BACKGROUND

Unmanned aerial vehicles (UAVs), which are often colloquially referred to as "drones," are becoming increasingly popular among consumers, businesses, and government. For example, large numbers of individuals and organizations are using UAVs mounted with video cameras to obtain high angle or downward facing video segments to supplement more conventional photography for such applications as video blogging, event photography, event monitoring, and/or the like. The typical UAV is controlled remotely by an operator using a hand-held controller that allows the operator to control altitude, orientation, direction, and velocity of the UAV as well as the photo, video, and/or other sensory functions of the UAV. During operation, the hand-held controller (and thus the operator) typically remains in line-of-sight or near line-of-sight with the UAV to allow the operator to monitor the flight of the UAV and to maintain bidirectional communications between an antenna on the hand-held controller and an antenna on the UAV, which typically have to remain within line-of-sight or near line-of-sight with each other. This typically limits the range of the UAV and may also place limitations on the bandwidth of the communications that may limit the amount and/or quality of photo or video data being transmitted from the UAV to the hand-held controller.

Much of North America and other parts of the world are serviced by sophisticated wireless communications networks that are capable of supporting high bandwidth bidirectional communications, such as 1×, 3G, 4G, 4G LTE, and 5G networks. These networks are typically used to support mobile devices such as cell phones, smart phones, tablets, lap tops, and/or the like and not only provide support for phone calls, text messages, and email, but also provide support for internet communication, video streaming, and/or other high bandwidth applications.

Accordingly, it would be advantageous to adapt the capabilities of these networks to support both line-of-sight and non-line-of-sight communication with and control of UAVs.

SUMMARY

The embodiments of the invention are best summarized by the claims that follow the description.

Consistent with some embodiments, an antenna system for an unmanned aerial vehicle (UAV) includes an antenna having a transmit-receive pattern, the radiation pattern having a peak strength in a direction aligned with a downward vertical axis of the antenna, a first strength reducing to a first predetermined strength below the peak strength at a first predetermined angle away from the downward vertical axis of the antenna, a second strength reducing to a second predetermined strength below the peak strength at a second predetermined angle away from the downward vertical axis of the antenna, and a third strength reducing to a third predetermined strength below the peak strength at angles greater than the second predetermined angle away from the from the downward vertical axis of the antenna. The second predetermined strength is further below the peak strength than the first predetermined strength and the second predetermined angle is greater than the first predetermined angle. The third predetermined strength is further below the peak strength than the second predetermined strength. The antenna system further includes a self-leveling antenna mount configured to mount the antenna to the UAV and maintain the downward vertical axis of the antenna in substantial alignment with a straight downward direction relative to the UAV despite a change in roll, pitch, or bank of the UAV.

Consistent with some embodiments, an antenna system for a UAV includes an antenna for receiving commands for the UAV via a network and for transmitting data from the UAV via the network and a self-leveling antenna mount configured to mount the antenna to the UAV. The antenna has a transmit-receive pattern with a peak strength in a first direction aligned with an axis of the antenna. The radiation pattern falls off in directions away from the axis. The self-leveling antenna mount is configured to adjust an orientation of the antenna to maintain substantial alignment between the first direction and a straight downward direction relative to the UAV despite a change in roll, pitch, or bank of the UAV.

Consistent with some embodiments, a UAV includes a body, an antenna for receiving commands for the UAV via a network and for transmitting data from the UAV via the network, and a self-leveling antenna mount configured to mount the antenna to the body. The antenna has a transmit-receive pattern with a peak strength in a first direction aligned with an axis of the antenna. The radiation pattern falls off in directions away from the axis. The self-leveling antenna mount is configured to adjust an orientation of the antenna to maintain substantial alignment between the first direction and a straight downward direction relative to the UAV despite a change in roll, pitch, or bank of the UAV.

In the figures, elements having the same designations have the same or similar functions.

DETAILED DESCRIPTION

In the following description, specific details are set forth describing some embodiments consistent with the present disclosure. It will be apparent, however, to one skilled in the art that some embodiments may be practiced without some or all of these specific details. The specific embodiments disclosed herein are meant to be illustrative but not limiting. One skilled in the art may realize other elements that, although not specifically described here, are within the scope and the spirit of this disclosure. In addition, to avoid unnecessary repetition, one or more features shown and described in association with one embodiment may be incorporated into other embodiments unless specifically described otherwise or if the one or more features would make an embodiment non-functional.

Figure 1A:
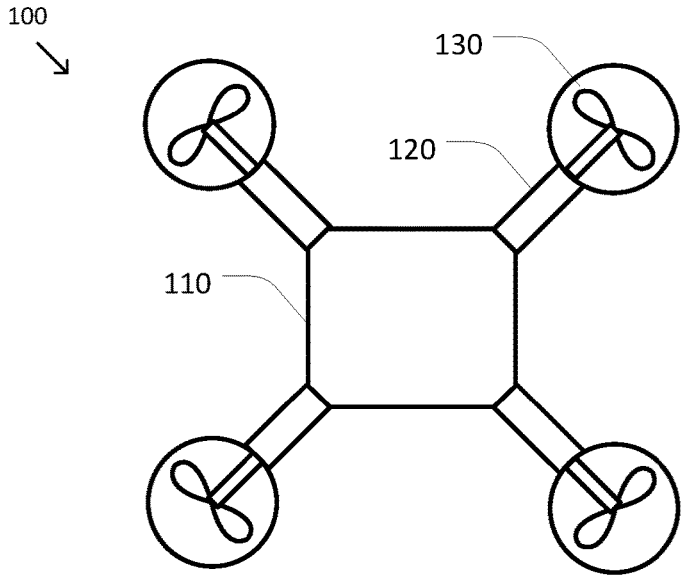
FIG. 1A is a simplified diagram of at top view of an unmanned aerial vehicle according to some embodiments.

FIG. 1A is a simplified diagram of a top view of an unmanned aerial vehicle (UAV) 100 according to some embodiments. As shown in FIG. 1A, UAV 100 includes a central body 110. Attached to each of the four corners of body 110 is a strut 120 coupling body 110 to a propeller 130. In some examples, steering and control of UAV 100 during flight is accomplished by independently controlling the rotation speed of each of the propellers 130, thus controlling the amount of lift provided by the respective propeller 130, which may be used to control at least a pitch, roll, and/or a bank of UAV 100, thus also controlling the direction of flight of UAV 100. And although, UAV 100 is representative of a four propeller UAV or quadcopter-style UAV, one of ordinary skill in the art would understand that other configurations of UAV 100 are possible, including UAVs with fewer than four or more than four propellers and/or with alternative forms of lift, propulsion, and/or other configurations, such as helicopter, plane, and/or other configurations, without being inconsistent with the embodiments disclosed herein.

Figure 1B:
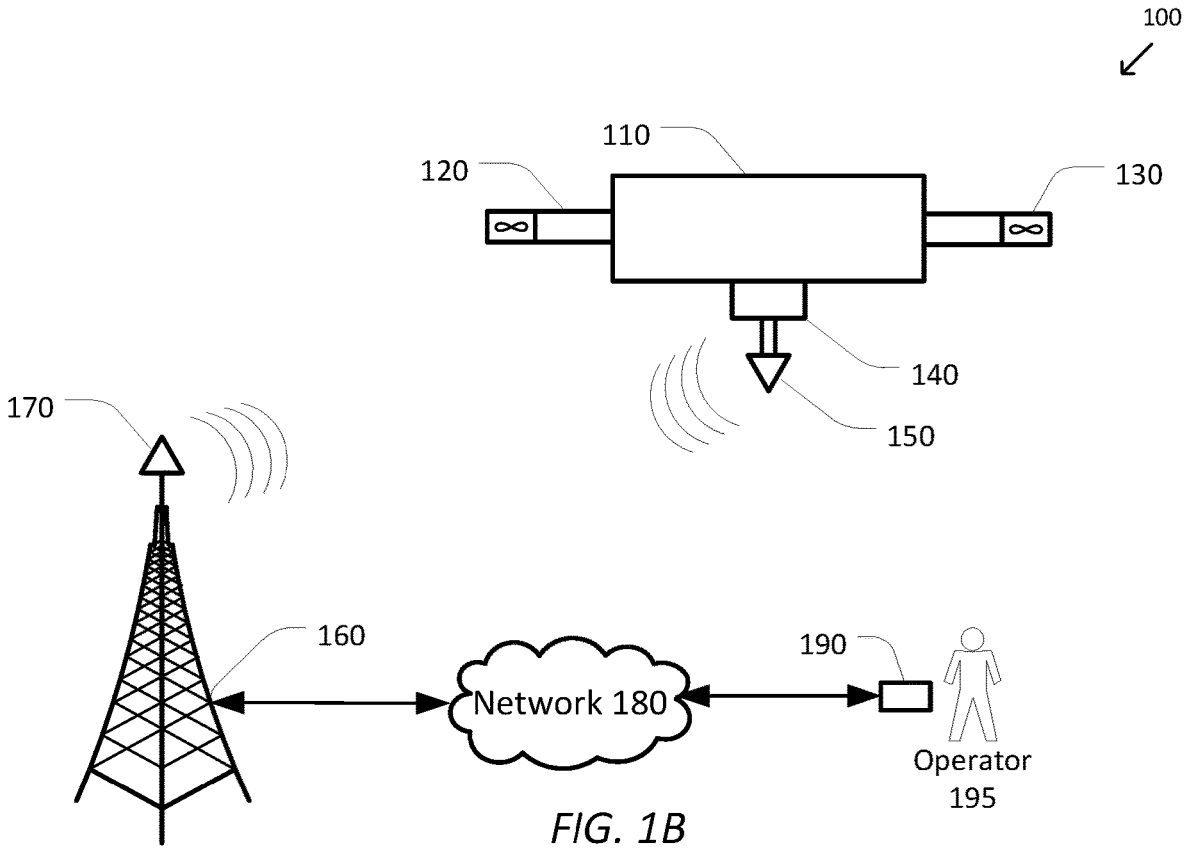
FIG. 1B is a simplified diagram of a side view of an unmanned aerial vehicle in communication with an antenna tower according to some embodiments.

FIG. 1B is a simplified diagram of a side view of unmanned aerial vehicle 100 in communication with an antenna tower 160 according to some embodiments. As shown in FIG. 1B, the underside of UAV 100 further includes an antenna mount 140 used to mount an antenna 150 to UAV 100. In some examples, antenna mount 140 is designed to be self-leveling. The self-leveling allows antenna mount 140 to control an orientation of antenna 150 so that antenna 150 remains in a substantially downward facing direction toward the ground (i.e., in the direction of gravity) even though, during operation, UAV 100 may be pitched, rolled, and/or banked so that body 110 does not maintain a consistent and/or constant orientation relative to the ground. Antenna 150 is used to emit and receive signals (e.g., radio frequency (RF) signals) to allow UAV 100 to receive commands from an operator using a controller and to send back telemetry data, images, video (e.g., 4K UL video), and/or the like to the operator and/or other destination.

FIG. 1B further shows antenna tower 160 with an antenna 170 mounted at the top of antenna tower 160. And although antenna 170 is shown at the top of antenna tower 160, one of ordinary skill in the art would understand that antenna 170 may be mounted at other locations on antenna tower 160 as is well understood in the art. Like antenna 150, antenna 170 is used to emit and receive signals (e.g., RF signals) used to send commands to UAV 100 and to receive data from UAV 100. In some examples, antenna tower 160 and antenna 170 may be part of a cellular communication network including many other antenna towers (not shown) and antennas (not shown), such as a network capable of supporting communications via 1×, 3G, 4G, 4G LTE, 5G, and/or the like. In some examples, antenna 150 may be a multiband antenna allowing antenna 150 and UAV 100 to communicate with antennas for various network types. In some examples, antenna 150 may be a multi-in multi-out (MIMO) antenna supporting at least two highly decorrelated antenna elements per communication band allowing for flexible use of antenna 150 with each of the various network types it supports.

Antenna 170 may be coupled to a network 180. Network 180 may include one or more network switching devices, such as routers, switches, hubs, and/or bridges, which forward messages and/or other communications between antenna 170 and a controller 190 for UAV 100 being operated by an operator 195. In practice, network 180 may include portions of the cellular network to which antenna 170 belongs as well as may include portions of other networks such as one or more local area networks (LANs), such as Ethernet protocol LANs, or wide area networks (WANs), such as the Internet. In some examples, controller 190 may be a hand-held controller for UAV 100 that is adapted to communicate with UAV 100 using network 180 and antenna 170. In some examples, controller 190 may be a smart phone, tablet, lap top, and/or other computing device running one or more applications that are usable by operator 195 to communicate with UAV 100, control UAV 100, and/or receive telemetry, photos, videos, and/or other data from UAV 100. Because operator 195 is using controller 190 to communicate with and control UAV 100 using network 180 and antenna 170, operator 195 no longer needs to remain within line-of-sight with UAV 100 in order to communicate with and control UAV 100.

As discussed above and further emphasized here, FIG. 1B is merely an example which should not unduly limit the scope of the claims. One of ordinary skill in the art would recognize many variations, alternatives, and modifications. In some embodiments, UAV 100 may include other components. In some examples, a protective boot and/or other sleeve may be used in conjunction with antenna mount 140 to provide a weather proof seal between antenna 150 and the interior of antenna mount 140 and/or UAV 100. In some examples, the weather proof seal may help protect UAV, antenna circuitry, and/or the like from rain, sleet, snow, ice, and/or other weather hazards. In some examples, antenna 150 and/or antenna mount 140 may be surrounded by a radome or other protective cover to protect antenna 150 from wind, rain, and/or other elements. In some examples, the radome may be non-conductive so as to minimize interference with the signals being transmitted or received by antenna 150.

Figure 2:
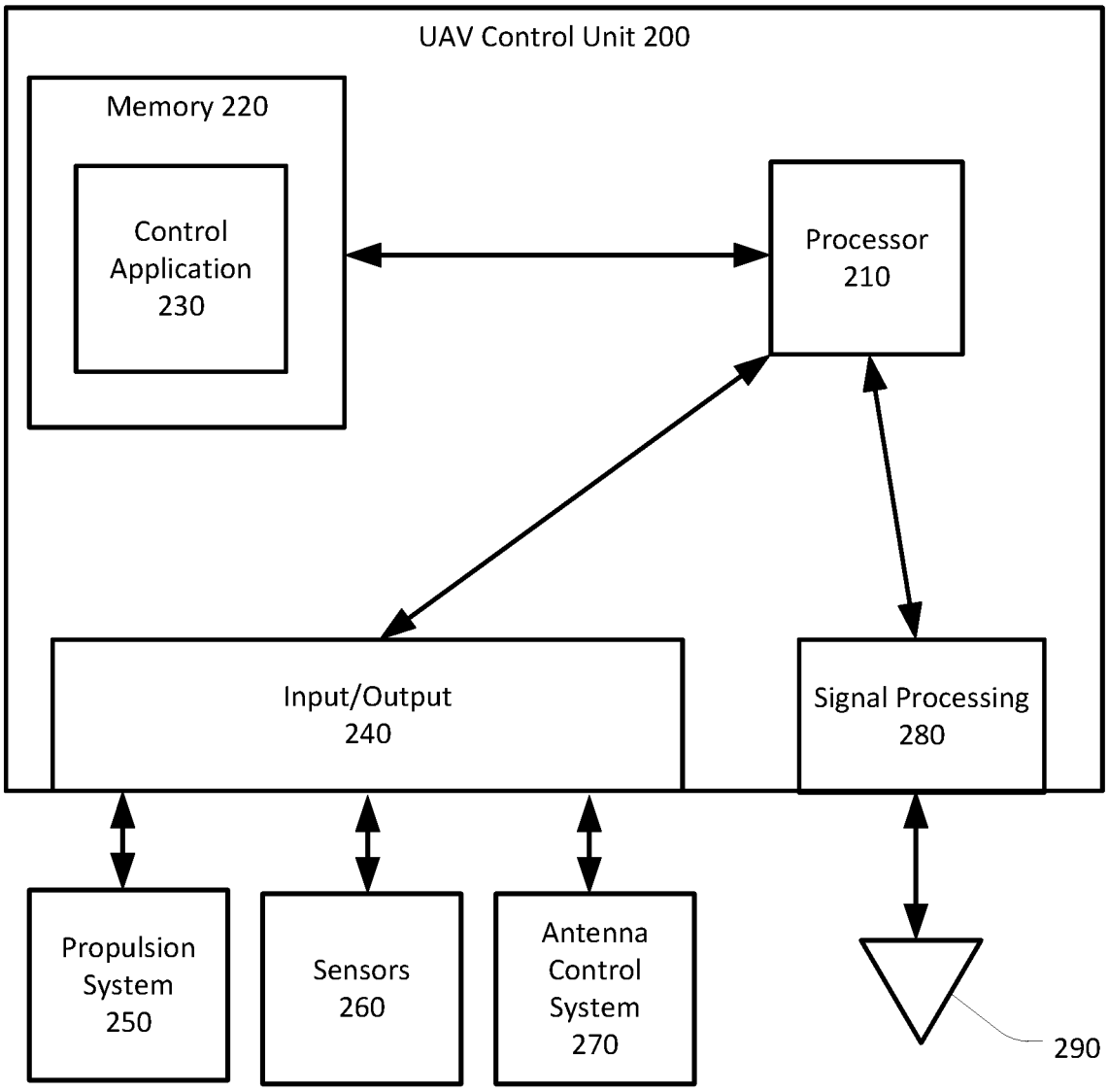
FIG. 2 is a simplified diagram of a control unit for an unmanned aerial vehicle according to some embodiments.

FIG. 2 is a simplified diagram of a control unit 200 for an unmanned aerial vehicle (UAV) according to some embodiments. According to some embodiments, control unit 200 may be suitable for use with UAV 100 and may, for example, be located somewhere on or within body 110. The organization of the systems, subsystems, and/or components of FIG. 2 should be considered representative only as other configurations of the systems, subsystems, and/or components are possible as would be understood by one of ordinary skill in the art. As shown in FIG. 2, control unit 200 includes a processor 210 coupled to memory 220. In some examples, processor 210 may control operation and/or execution of hardware and/or software on control unit 200 and, by extension through various inputs and output, other components in the UAV. Although only one processor 210 is shown, control unit 200 may include multiple processors, multi-core processors, microprocessors, digital signal processors (DSPs), application specific integrated circuits (ASICs), field programmable gate arrays (FPGAs), and/or the like. Memory 220 may include one or more types of machine readable media. Some common forms of machine readable media may include RAM, PROM, EPROM, FLASH-EPROM, any other memory chip or cartridge, and/or any other medium from which a processor or computer is adapted to read.

Memory 220 may be used to store an operating system (not shown) and/or one or more applications that are executed by processor 210. This includes at least control application 230. Control application 230 may include software and other data structures usable to operate control unit 200 and to control the UAV as well as provide data from the UAV to other devices.

Control unit 200 further includes an input/output system 240 and signal processing circuitry 280. Input/output system 240 is used to couple control unit 200 to other systems, subsystems and/or components of the UAV. The other systems, subsystems, and/or components include at least propulsion system 250 and sensors 260. Propulsion system 250 includes motors used to rotate corresponding propellers, such as propellers 130, used to control altitude, orientation, direction, and velocity of the UAV. Each of the motors may be controlled using a suitable feedback control system such as a proportional-integral-derivative (PID) controller, servo controller, and/or the like. Sensors 260 include one or more sensors for monitoring operation of the UAV and/or collecting data. In some examples, sensors 260 may include one or more tachometers for reporting propeller speed, altimeters, positioning systems (e.g., a GPS positioning system), inertial management units, magnetometers, gyroscopes, accelerometers, air bubble sensors, attitude sensors, air speed sensors, temperature sensors, and/or the like including suitable biasing, signal conditioning, and/or related circuitry. In some examples, sensors 260 may further include one or more cameras (still and/or video) for capturing images and/or video from the vantage point of the UAV that, for example, may be used, for example, to send images and/or video as well as other telemetry data to the operator to support non-line-of-sight operation of the UAV.

In some examples, the other systems, subsystems, and/or components may optionally include an antenna control system 270 used to actively control orientation of antenna 290. Antenna control system 270 includes one or more servo motors or other actuators and corresponding feedback controllers (e.g., PID controllers, servo controllers, and/or the like) for actively controlling the orientation of an antenna 290 located on the UAV. In some examples, antenna control system 270 may use inputs from one or more of the altimeters, positioning systems, inertial management units, magnetometers, gyroscopes, accelerometers, air bubble sensors, attitude sensors, air speed sensors, and/or the like to determine whether antenna 290 is oriented downward and to correct the orientation of antenna 290 so that is points substantially downward despite changes in the pitch, roll, and/or bank of the UAV.

Signal processing circuitry 280 includes one or more circuits for processing signals, such as RF signals, received by antenna 290 and signals to be transmitted by antenna 290. In some examples, signal processing circuitry 280 may include one or more amplifiers, filters, coder-decoders (CODECs), schedulers, signal conditioners, and/or the like. In some examples, one or more of the capabilities of signal processing circuitry 280 may be implemented using one or more suitably programmed DSPs. In some examples, signal processing circuitry 280 may be used to communicate using one or more cellular data standards including 1×, 3G, 4G, 4G LTE, 5G, and/or the like.

Antenna 290 is used to communicate with one or more antenna towers to receive commands from an operator and to send telemetry, photo, video, and/or the like to the operator. In some examples, antenna 290 may be consistent with antenna 150. In some examples, antenna 290 may be a multiband antenna allowing antenna 290 and UAV 100 to communicate with antennas for various network types. In some examples, antenna 290 may be a multi-in multi-out (MIMO) antenna supporting at least two highly decorrelated antenna elements per communication band allowing for flexible use of antenna 290 with each of the various network types it supports.

According to some embodiments, the design of antennas 150 and/or 290 presents challenges. Typical cellular antennas for smart phones, tablets, etc. are omnidirectional. This allows for good signal coverage no matter the orientation of the antenna relative to the nearby antenna towers. In addition, these antennas are often implemented with signal strengths designed to address the challenges of higher and often highly variable attenuation of signals near the ground due to Fresnel zone factors as well as ground clutter due to interference from objects such as buildings, trees, hills, automobiles, trucks, and/or the like.

In contrast, UAVs are typically designed to be operated in open spaces where there is reduced ground clutter or at an altitude where they are above ground clutter. In these more open areas, the UAV is often within direct line-of-sight or near direct-line of sight with multiple antenna towers. In addition, the attenuation of the signals is often much lower than for ground-based cellular devices and attenuates by the much lower factor of $(4\pi df/c)^2$. As a consequence, the antenna on the UAV is often able to achieve strong reception from a larger number of antenna towers than ground-based cellular devices. This may significantly interfere with the ability of the UAV to reliably receive commands from the operator as the antenna on the UAV may be subject to much more interference from the larger number of nearby antenna towers, from which the UAV is receiving signals. As a result, this may significantly degrade the ability of the operator to safely control the UAV, especially when the UAV is being operated without direct line-of-sight by the operator. In addition, when the antenna on the UAV is used to transmit large amounts of telemetry, image, video, and/or other data, such as 4K UL video, the transmission may be detectable by a larger than normal number of antenna towers, including antenna towers that may be some distance from the antenna tower acting as the serving node for the UAV. This transmission then, in effect, interferes with the communication capabilities of these other antenna towers so that it ultimately raises the noise floor for the other antenna towers. The result is degraded service for all the other devices communicating with these other antenna towers.

Figure 3:
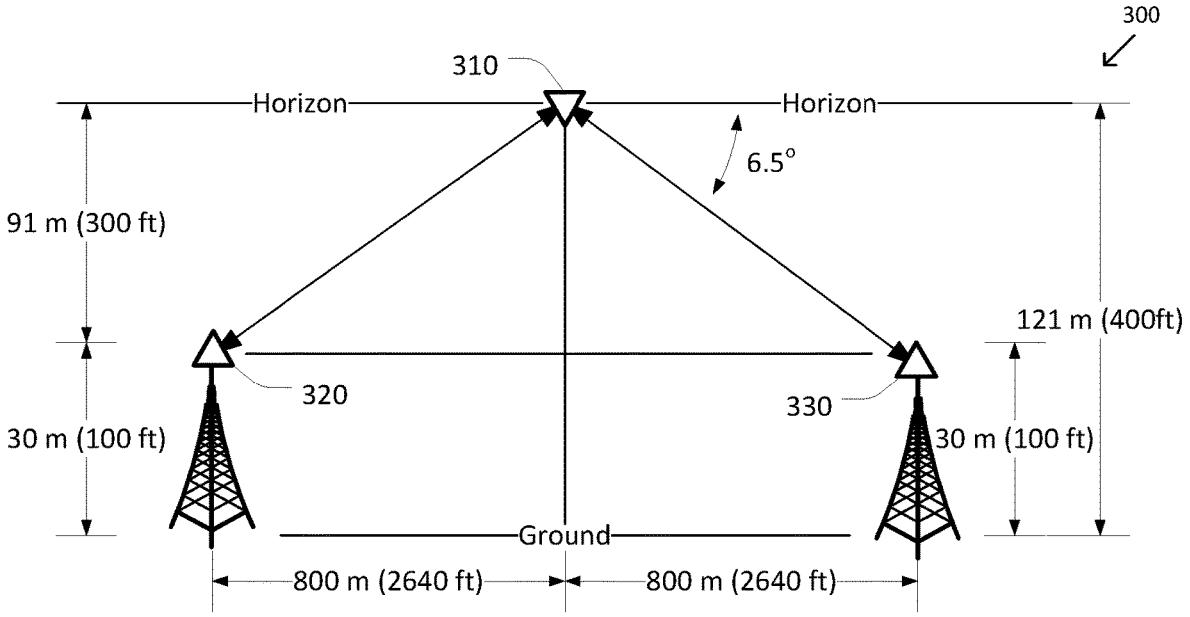
FIG. 3 is a simplified diagram of a communication geometry between an unmanned aerial vehicle and nearby antenna towers according to some embodiments.

Accordingly, antennas for use in UAVs, such as those described herein, to communicate with cellular networks may preferably avoid designs based on omnidirectional radiation patterns, but are instead designed based on the different transmitter-receiver geometries, expected lines-of-sight, and/or attenuations to be expected with UAV operation. FIG. 3 is a simplified diagram of communication geometry 300 between an unmanned aerial vehicle and nearby antenna towers according to some embodiments. FIG. 3 makes several assumptions regarding the operation of the UAV as well the arrangement and configuration of the nearby antenna towers in order to provide a person of ordinary skill in the art having the benefit of the present disclosure with a better understanding of communication geometry 300 and in order to explain potential design parameters for antenna 310 in the UAV. It is understood, however, that communication geometry 300 is representative only and that other communication geometries between the UAV and the antenna towers are possible.

As shown in FIG. 3, the UAV is operating at 121 meters (400 feet) above the ground, which is the current upper limit set for civilian UAVs by the Federal Aviation Administration (FAA) in order to limit UAV interference with other airborne vehicles. Thus, antenna 310 is shown at a height of 121 meters above the ground. The antenna towers are shown with a spacing of 1600 meters (1 mile or 5280 feet) and with a height of 30 meters (100 feet). Thus, antennas 320 and 330 are shown at a height of 30 meters (100 feet) off the ground and 1600 meters (1 mile or 5280 feet) apart). Antenna 310 is further shown equidistant between antennas 320 and 330 (800 meters or 2640 along the ground to each of antennas 320 and 330) and at a height of 91 meters (300 feet above antennas 320 and 330). Under communication geometry 300, the angle between the horizon and antennas 320 and 330 from the perspective of antenna 310 on the UAV is $\tan^{-1}(91/800)=6.5$ degrees. Thus, communication geometry 300 suggests that antenna 310 should be designed to have a reduced radiation pattern at angles above 6.5 degrees below the horizon. For angles below 6.5 degrees below the horizon, the radiation pattern should be as nearly uniform as possible in order to communicate with antenna towers no matter where they are in the coverage area near the UAV. In practice, a radiation pattern that is at least −5 to −10 dB below a maximum radiation strength for angles above a threshold angle of 5 to 15 degrees below the horizon and nearly uniform at angles below the threshold angle can be suitable for a UAV antenna as described herein, such as antenna 150, 290, and/or 310 according to some embodiments.

Figure 4:
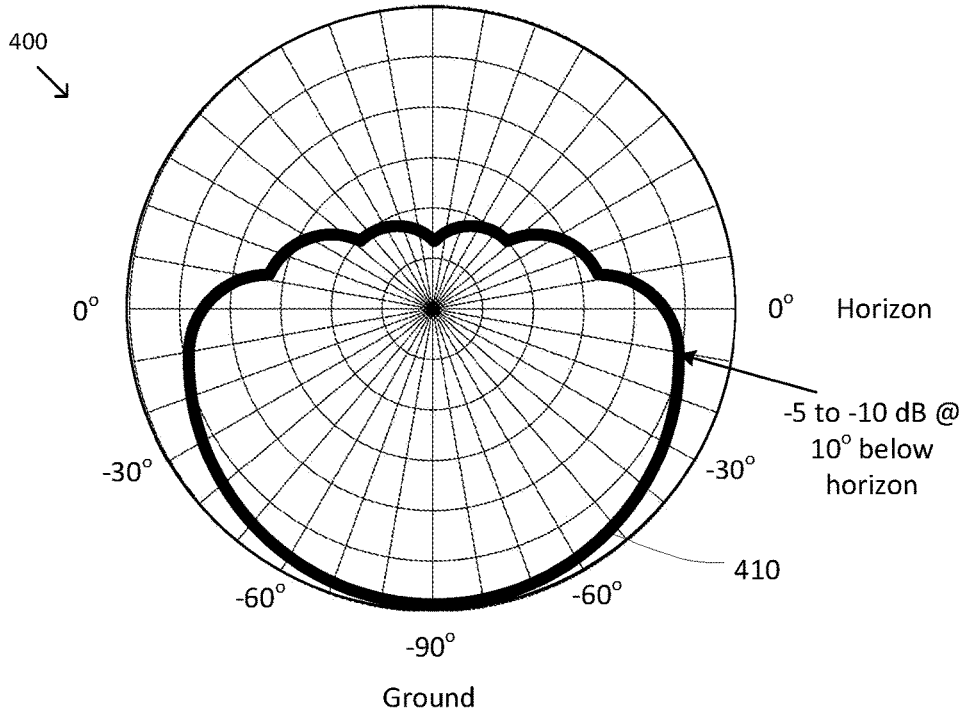
FIG. 4 is a simplified diagram of an antenna radiation pattern according to some embodiments.

FIG. 4 is a simplified diagram of an antenna radiation pattern 400 according to some embodiments. According to some embodiments, antenna radiation pattern 400 is representative of a radiation pattern for antennas 150, 290, and/or 310 subject to the geometric observations of communication geometry 300 of FIG. 3. As shown in FIG. 4, antenna radiation pattern 400 is represented by a radiation pattern strength curve 410 depicted as antenna signal power for transmitting and antenna signal sensitivity for receiving versus angle relative to the horizon. The horizon is depicted as zero degrees with angles below the horizon indicated via negative angles to directly downward toward the ground as −90 degrees. And although, FIG. 4 shows antenna radiation pattern 400 in two dimensions, antenna radiation pattern 400 will, in many cases, be rotationally symmetrical about the vertical or straight down/straight up axis (−90 degrees as shown in FIG. 4) so that antenna radiation pattern 400 and radiation pattern strength curve 410 each have a constant value irrespective of a rotational angle about the vertical axis. Radiation pattern strength curve 410 includes a peak strength at −90 degrees (i.e., straight downward) and maintains a nearly uniform strength that falls off about −5 to −10 decibels (dB) below the peak strength at about 10 degrees below the horizon. Above 10 degrees below the horizon, radiation pattern strength curve 410 falls off more rapidly so that radiation pattern strength curve 410 has a lower strength (about −7.5 to −15 dB below the peak strength) at the horizon and a significantly lower strength (to as much as −20 to −40 dB or more below the peak strength) above the horizon where antenna towers would not generally be located when the corresponding antenna is being operated at a likely cruising altitude for a UAV (e.g., 121 meters/400 feet). In some examples, antenna radiation pattern 400 may be implemented using a suitably designed and/or tuned dipole antenna, patch antenna, beam antenna, and/or the like.

In order for antenna radiation pattern 400 to be effective at reducing a number of antenna towers that are within communication range with the UAV, such as by satisfying the geometric observations of communication geometry 300, orientation of the corresponding antenna should be maintained so that the vertical axis of the corresponding antenna is in an approximately straight down direction despite any roll, pitch, and/or bank of the UAV. Thus, according to some embodiments, the orientation of the antenna relative to the UAV is passively and/or actively altered to maintain substantial alignment between the vertical axis of the antenna and the straight down direction (e.g., within 10 degrees and preferably within 5 degrees between the vertical axis of the antenna and the straight down direction).

Figure 5C:
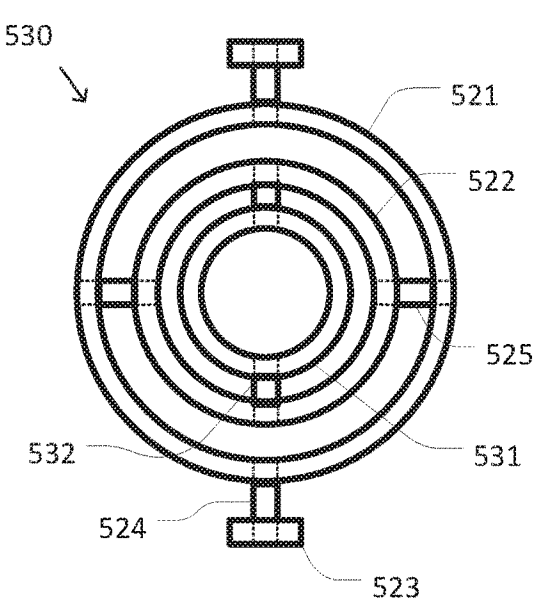
FIGS. 5A-5C are simplified diagrams of antenna mounting systems according to some embodiments.
Figure 5B:
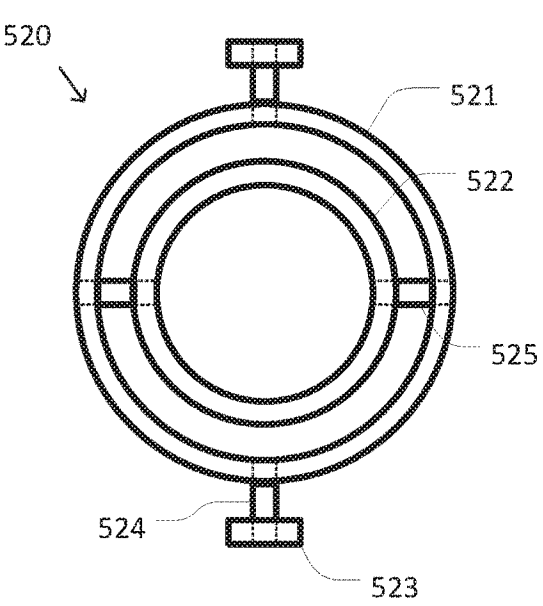
Figure 5A:
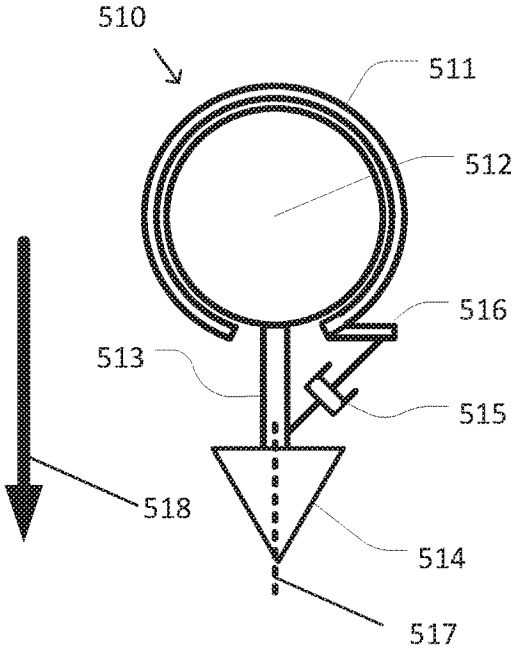

FIGS. 5A-5C are simplified diagrams of antenna mounting systems according to some embodiments. The antenna mounting systems of FIGS. 5A-5C are usable to maintain and/or control alignment of a vertical axis of an antenna, such as antenna 150, 290, and/or 310, so that the vertical axis of the antenna remains in substantial alignment with a straight downward direction irrespective of a roll, pitch, and/or bank of a UAV, such as UAV 100, to which the antenna is mounted. In some examples, the antenna mounting systems of FIGS. 5A-5C are suitable for use as antenna mount 140.

FIG. 5A is a simplified diagram of a cross-sectional view of a ball-and-socket antenna mounting system 510 according to some embodiments. As shown in FIG. 5A, the ball-and-socket antenna mounting system 510 includes a spherical socket 511 that is mounted to an underside of the UAV, such as is shown in representative fashion in FIG. 1B. Although not shown in FIG. 5A, spherical socket 511 may be mounted to the UAV using one or more brackets, flanges, welds, adhesives, and/or the like. Located within spherical socket 511 is a ball 512 that has a diameter that is smaller than an inside diameter of spherical socket 511. In some embodiments, one or more rollers, bearings, lubricants, and/or the like may be present between spherical socket 511 and ball 512 in order to support free movement of ball 512 relative to spherical socket 511. Located at a bottom end of ball 512 is an antenna mounting shaft 513 used to mechanically couple an antenna 514 to ball 512. As also shown in FIG. 5A, spherical socket 511 includes an opening, such as a circular opening, that allows ball 512 to rotate relative to spherical socket 511 without antenna mounting shaft 513 making contact with spherical socket 511 over an expected range of pitch, roll, and/or bank angles of the UAV. In some examples, the ball-and-socket antenna mounting system 510 is a passive alignment system such that as the UAV executes various roll, pitch, and/or bank maneuvers, gravitational pull on antenna 514 and antenna mounting shaft 513 helps keep the vertical axis 517 of antenna 514 in substantial alignment with the straight downward direction 518 despite rotation of spherical socket 511 relative to ball 512 due to the roll, pitch, and/or bank maneuvers.

In some embodiments, ball-and-socket antenna mouting system 510 may optionally include one or more damping mechanisms in order to improve the stability of mounting shaft 513 and/pr antenna 514 during operation such that the effects of wind, centripetal forces, and/or the like are minimized. In some example, the one or more damping mechanisms may be be mounted between shaft 513 and either spherical socket 511 or the UAV as is shown by a representative damper 515 mounted between shaft 513 and a flange or bracket 516 attached to spherical socket 511. In some examples, the one or more damping mechanisms may include one or more springs, dashpots, shock absorbers, and/or the like. In some examples, the one or more damping mechanisms may include at least two dampers configured to orthogonal to each other to damp motion in at least two orthogonal directions relative to the UAV. In some examples, the design, size, and/or dampening strength of the one or more damping mechanisms may be based on the size of antenna 514, expected wind loads, expected maneuvering accelerations, and/or the like. In some examples, the amount of damping by the one or more damping mechanisms may be adjusted based on the amount of alignment between shaft 513 and the straight downward direction, an orientation of shaft 513 relative to the UAV, and/or the like. In some examples, the amount of damping may be controlled by adjusting one or more electrical signals, gas pressures, fluid pressures, and/or the like in the one or more damping mechanisms. In some examples, alternative damping approaches may be used including viscous damping within spherical socket 511, one or more brakes increasing friction between ball 512 and spherical socket 511, and/or the like.

FIG. 5B is a simplified diagram of a top view of a two-axis gimbal antenna mounting system 520 according to some embodiments. As shown in FIG. 5B, the two-axis gimbal antenna mounting system 520 includes a first ring 521. First ring 521 is coupled to a pair of mounting brackets or flanges 523 via a pair of corresponding shafts or pins 524 located at opposite sides of first ring 521 along a first axis that passes through a center point of a circle defined by first ring 521. Shafts 524 allow free rotation of first ring 521 relative to mounting brackets 523 along the first axis, thus providing the first of the two axes for the two-axis gimbal antenna mounting system 520. The two-axis gimbal antenna mounting system 520 further includes a second ring 522 located within first ring 521. Second ring 522 is coupled to first ring 521 via a pair of corresponding shafts or pins 525 located at opposite sides of second ring 522 along a second axis that passes through a center point of a circle defined by second ring 522 that is concentric with the center point of the circle defined by first ring 521. As shown in FIG. 5B, the second axis is perpendicular to the first axis, but such an arrangement is not required in all embodiments. Shafts 525 allow free rotation of second ring 522 relative to first ring 521 along the second axis, thus providing the second of the two axes for the two-axis gimbal antenna mounting system 520. In some examples, the antenna (not shown) may be mounted to second ring 522, such as by a shaft similar to antenna mounting shaft 513 and mounting brackets 523 may be mounted to the UAV. In some examples, the antenna may be mounted to mounting brackets 523 and the UAV to second ring 522 via a shaft (not shown). In some examples, the two-axis gimbal antenna mounting system 520 is a passive alignment system such that as the UAV executes various roll, pitch, and/or bank maneuvers, gravitational pull on the antenna and the free rotation along the first and second axes helps keep the vertical axis of the antenna in substantial alignment with the straight downward direction despite rotation of mounting brackets 523 relative to second ring 522 due to the roll, pitch, and/or bank maneuvers.

Although not shown in FIG. 5B, in some embodiments, two-axis gimbal antenna mounting system 520 may include one or more damping mechanisms similar to damper 515 of ball-and-socket antenna mounting system 510. In some examples, as an alternative to one or more dampers similar to damper 515, two-axis gimbal antenna mounting system 520 may include one or more brakes (not shown) for controlling the ease with which shafts 524 and/or 525 rotate. In some examples, the one or more brakes may include mechanical, electrical, magnetic, pneumatic, hydraulic, and/or the like mechanisms for increases an amount of resistance to rotation of shafts 524 and/or 525. In some examples, the design, size, and/or dampening strength of the one or more damping mechanisms may be based on the size of antenna 514, expected wind loads, expected maneuvering accelerations, and/or the like. In some examples, the amount of damping by the one or more damping mechanisms may be adjusted based on the amount of rotation of shafts 524 and/or 525, and/or the like.

FIG. 5C is a simplified diagram of a top view of a three-axis gimbal antenna mounting system 530 according to some embodiments. As shown in FIG. 5C, the three-axis gimbal antenna mounting system 530 is built upon the two-axis gimbal antenna mounting system 520, but includes an additional third ring 531 located within second ring 522. Third ring 531 is coupled to second ring 522 via a pair of corresponding shafts or pins 532 located at opposite sides of third ring 531 along a third axis that passes through a center point of a circle defined by third ring 531 that is concentric with the center point of the circle defined by the first ring 521 and the second ring 522. As shown in FIG. 5C, the third axis is perpendicular to the second axis, but such an arrangement is not required in all embodiments. Shafts 532 allow free rotation of third ring 531 relative to second ring 522 along the third axis, thus providing the third of the three axes for the three-axis gimbal antenna mounting system 530. In some examples, the antenna (not shown) may be mounted to third ring 531, such as by a shaft similar to antenna mounting shaft 513 and mounting brackets 523 may be mounted to the UAV. In some examples, the antenna may be mounted to mounting brackets 523 and the UAV to third ring 531 via a shaft (not shown). In some examples, the three-axis gimbal antenna mounting system 530 is a passive alignment system such that as the UAV executes various roll, pitch, and/or bank maneuvers, gravitational pull on the antenna and the free rotation along the first, second, and third axes helps keep the vertical axis of the antenna in substantial alignment with the straight downward direction despite rotation of mounting brackets 523 relative to third ring 531 due to the roll, pitch, and/or bank maneuvers.

Although not shown in FIG. 5C, in some embodiments, three-axis gimbal antenna mounting system 530 may include one or more damping mechanisms similar to damper 515 of ball-and-socket antenna mounting system 510. In some examples, as an alternative to one or more dampers similar to damper 515, three-axis gimbal antenna mounting system 530 may include one or more brakes (not shown) for controlling the ease with which shafts 524, 525, and/or 532 rotate. In some examples, the one or more brakes may include mechanical, electrical, magnetic, pneumatic, hydraulic, and/or the like mechanisms for increases an amount of resistance to rotation of shafts 524, 525, and/or 532. In some examples, the design, size, and/or dampening strength of the one or more damping mechanisms may be based on the size of the antenna, expected wind loads, expected maneuvering accelerations, and/or the like. In some examples, the amount of damping by the one or more damping mechanisms may be adjusted based on the amount of rotation of shafts 524, 525, and/or 532, and/or the like.

As discussed above and further emphasized here, FIGS. 5A-5C are merely examples which should not unduly limit the scope of the claims. One of ordinary skill in the art would recognize many variations, alternatives, and modifications.

In some embodiments, each of the mounting systems 510-530 may be equipped with active control systems to help further ensure that the vertical axis of an antenna mounted using each of the mounting systems 510-530 is substantially aligned with the straight downward direction without having to rely solely on gravity. In some examples, one or more positioning systems, inertial management units, magnetometers, gyroscopes, accelerometers, air bubble sensors, attitude sensors, and/or the like, such as those included with sensors 260, may be used to determine an amount of roll, pitch, and/or bank of the UAV and use that information to determine a difference or error between an orientation of the vertical axis of the antenna and the straight downward direction. The difference in orientations is then used to control one or more actuators to actively guide the vertical axis of the antenna toward the straight downward direction.

In some examples, a coordinate reference frame for each of the UAV, the antenna, and the ground reference is maintained. As the UAV is maneuvered, the one or more actuators are used to adjust differences between the UAV coordinate reference frame and the antenna coordinate reference frame so as to move the downward vertical direction in the antenna coordinate reference frame with the straight down direction in the ground reference coordinate reference frame. In some examples, one or more coordinate transformation matrices may be used to determination one or more axes of rotation and corresponding angular distances by which to rotate the antenna coordinate reference frame relative to the UAV coordinate reference frame to bring the downward vertical direction in the antenna coordinate reference frame with the straight down direction in the ground reference coordinate reference frame. In some examples, the one or more actuators may be part of antenna control system 270.

In some examples, when the antenna mounting system is the ball-and-socket antenna mounting system 510, the one or more actuators may be used to drive one or more rollers, balls, and/or the like located on an interior face of spherical socket 511 in order to control the orientation of ball 512 and correspondingly antenna 514. In some examples, when the antenna system is the ball-and-socket antenna mounting system 510, the one or more actuators may include one or more piezoelectric motors located on the interior face of spherical socket 511 in order to control the orientation of ball 512 and correspondingly antenna 514.

In some examples, when the antenna system is the two-axis gimbal antenna mounting system 520 or the three-axis gimbal antenna mounting system 530, the one or more actuators may correspond to motors, located in at least one of each pair of shafts 524, 525, and/or 532, that impart a torque on each of the first through third rings 521, 522, and 531, respectively, to help align the respective ring about its corresponding axis in order to control the orientation of the antenna mounted to the gimbal relative to the UAV.

Some examples of UAV 100 may include non-transitory, tangible, machine readable media that include executable code that when run by one or more processors (e.g., processor 210) may cause the one or more processors to perform processes to receive commands from an operator via an antenna (e.g., antenna 150, 290, and/or 310); send telemetry, image, video, and/or other data to the operator using the antenna; monitor roll, pitch and/or bank of the UAV; and/or actively control orientation of the vertical axis of the antenna so that it remains substantially aligned with a straight downward direction. Some common forms of machine readable media that may include these processes are, for example RAM, PROM, EPROM, FLASH-EPROM, any other memory chip or cartridge, and/or any other medium from which a processor or computer is adapted to read.

Although illustrative embodiments have been shown and described, a wide range of modification, change and substitution is contemplated in the foregoing disclosure and in some instances, some features of the embodiments may be employed without a corresponding use of other features. One of ordinary skill in the art would recognize many variations, alternatives, and modifications. Thus, the scope of the invention should be limited only by the following claims, and it is appropriate that the claims be construed broadly and in a manner consistent with the scope of the embodiments disclosed herein.

What is claimed is:

1. An antenna system for an unmanned aerial vehicle (UAV), the system comprising:

an antenna for receiving commands for the UAV via a network and for transmitting data from the UAV via the network; and a self-leveling antenna mount configured to mount the antenna to the UAV;

wherein:

the antenna has a radiation pattern with a peak strength in a first direction aligned with an axis of the antenna, the radiation pattern falling off in directions away from the axis of the antenna; and the self-leveling antenna mount is configured to adjust an orientation of the antenna to maintain the axis of the antenna in substantial alignment with a straight downward direction relative to the UAV despite a change in roll, pitch, or bank of the UAV.

2. The system of claim 1, wherein:

the radiation pattern has a first strength that falls off at least 5 decibels below the peak strength in directions that are greater than a first angle from the first direction; and the first angle is between 75 and 85 degrees.

3. The system of claim 1, wherein a type of the antenna is selected from a group consisting of a dipole antenna, a patch antenna, and a beam antenna.

4. The system of claim 1, wherein the self-leveling antenna mount includes one or more damping mechanisms.

5. The system of claim 1, wherein the self-leveling antenna mount is a ball-and-socket antenna mount or a gimbal antenna mount.

6. The system of claim 1, wherein the axis of the antenna is a downward vertical axis of the antenna.

7. The system of claim 1, wherein the radiation pattern has a first strength reducing to a first predetermined strength below the peak strength at a first predetermined angle away from the axis of the antenna.

8. The system of claim 7, wherein:

the first predetermined strength is between 5 and 10 decibels (dB) below the peak strength; and the first predetermined angle is between 75 and 85 degrees.

9. The system of claim 7, wherein the radiation pattern has a second strength reducing to a second predetermined strength below the peak strength at a second predetermined angle away from the axis of the antenna, the second predetermined strength being further below the peak strength than the first predetermined strength and the second predetermined angle being greater than the first predetermined angle.

10. The system of claim 9, wherein the second predetermined angle is 90 degrees.

11. The system of claim 9, wherein the radiation pattern has a third strength reducing to a third predetermined strength below the peak strength at angles greater than the second predetermined angle away from the from the axis of the antenna, the third predetermined strength being further below the peak strength than the second predetermined strength.

12. The system of claim 1, further comprising:

one or more sensors for determining an orientation of the UAV relative to the straight downward direction;

one or more actuators coupled to the self-leveling antenna mount; and a control system for altering, using the one or more actuators, an orientation of the antenna relative to the UAV based on the orientation of the first direction relative to the straight downward direction.

13. The system of claim 12, wherein the one or more sensors are each selected from a group consisting of an inertial management unit, a magnetometer, a gyroscope, an accelerometer, an air bubble sensor, and an attitude sensor; and the one or more actuators are each selected from a group consisting of a motor, a servo motor, and a piezoelectric motor.

14. The system of claim 1, wherein the self-leveling antenna mount comprises an outer socket configured to be mounted to the UAV and an inner ball mounted to the antenna.

15. The system of claim 14, wherein the self-leveling antenna mount further comprises one or more bearings or rollers between the outer socket and the inner ball.

16. The system of claim 1, wherein the self-leveling antenna mount comprises a gimbal having at least two concentric rings configured to rotate relative to each other and relative to the UAV.

* * * * *